US005524893A

United States Patent [19]

McGinnis et al.

[11] Patent Number: 5,524,893

[45] Date of Patent: Jun. 11, 1996

[54] APPARATUS FOR GOLF SWING TRAINING

[76] Inventors: Cameron J. McGinnis; M. Warren Fuller, both of 80 Athabascan Avenue, Sherwood Park, Alberta, Canada, T8A 4E3

[21] Appl. No.: 505,561

[22] Filed: Jul. 21, 1995

[51] Int. Cl.[6] ..... A63B 69/36

[52] U.S. Cl. ..... 473/229; 482/129; 473/267; 473/409

[58] Field of Search ..... 273/186.2, 187.4, 273/191 B, 35 A; 434/252; 482/129

[56] References Cited

U.S. PATENT DOCUMENTS

| | | | |
|---|---|---|---|
| 725,876 | 4/1903 | Roche | 482/129 |
| 2,103,502 | 12/1937 | Webster | 273/188 |
| 2,455,707 | 12/1948 | Sheffer | 273/191 B |
| 2,498,006 | 2/1950 | Ridill | 273/187.2 |
| 2,655,378 | 10/1953 | Sheffer | 273/191 B |
| 2,788,214 | 4/1957 | Tilden | 273/191 B |
| 2,848,234 | 8/1958 | Brandon | 273/191 B |
| 3,083,016 | 3/1963 | Sumegi | 273/191 B |
| 3,110,495 | 11/1963 | Carter | 273/186.1 |
| 3,462,156 | 8/1969 | Gentry | 273/191 B |
| 3,595,583 | 7/1971 | Oppenheimer | 273/191 R |
| 3,604,712 | 9/1971 | Lansing et al. | 273/186 R |
| 3,703,294 | 11/1972 | Fitch | 273/191 R |
| 4,034,991 | 7/1977 | Oppenheimer | 273/191 B X |
| 4,181,310 | 1/1980 | Boehmer | 273/191 B X |
| 4,353,556 | 10/1982 | Self et al. | 273/191 B X |
| 4,383,687 | 5/1983 | Wolff | 273/35 A |
| 4,944,518 | 7/1990 | Flynn | 273/191 B X |
| 5,013,045 | 5/1991 | Elmore | 273/191 B X |
| 5,139,264 | 8/1992 | Wootten | 273/191 B X |
| 5,149,099 | 9/1992 | Radakovich | 273/189 R |
| 5,158,299 | 10/1992 | Otter | 273/191 B X |

*Primary Examiner*—George J. Marlo
*Attorney, Agent, or Firm*—Rodman & Rodman

[57] ABSTRACT

An apparatus and method for use by a golfer for simulating a golf swing. The apparatus comprises a platform for the golfer to stand on, a handle for gripping by the golfer when simulating the golf swing, and two resistance cords extending between the handle and the platform for providing a first and second resistance during performance of the golf swing by the golfer. The method comprises the steps of standing on the platform in a golf stance, gripping the handle using a golf grip, and then performing the golf swing. The method may also be performed using a simplified apparatus which does not include the platform, as long as the spacial relationship amongst the handle, the resistance cords and the golfer which is provided by the platform is maintained during performance of the method while using the simplified apparatus.

30 Claims, 8 Drawing Sheets

26
28

34
20
58
38
32
56
46
30
70
44
116
54
104
52
104'
42(40')
40(42')
112
116'
92
92'
70'
110
90'
90
68'
68
48
50
114'
114
122
36

APPARATUS FOR GOLF SWING TRAINING

TECHNICAL FIELD

The present invention relates to an apparatus for use by a golfer for encouraging body motions creating a swing arc when simulating a golf swing while using the apparatus.

BACKGROUND ART

Various devices have been developed to assist golfers in learning, and reinforcing through practice, an improved golf swing in order to improve their golf games. These devices seek to improve the golfer's swing by guiding either the golf club head or a simulated golf club grip along a specific path. Some of these devices also provide resistance to the performance of the golfer's swing in order to strengthen the golfer's muscles. Examples of these devices are discussed below.

U.S. Pat. No. 3,083,061, issued Mar. 26, 1963 to Sumegi is directed at a golf swing teaching and practising device. The device is comprised of a handle for gripping by the golfer, a platform on which the golfer stands to use the device and a single resilient member in the form of a tension spring connected between the handle and the platform. To alter the exercising force, the point of connection of the spring to the platform is varied. Although the device acts to resist the movement of the handle, which acts as a simulated golf club grip, the device does not act effectively throughout the entire golf swing and it cannot promote an appropriate or desirable swing arc of the grip since the grip is connected to the platform by the tension spring at only a single connection point.

U.S. Pat. No. 4,353,556, issued Oct. 12, 1982 to Self et al is directed at a golf training aid which is comprised of an alignment band and two opposed tension members. The alignment band is attached to a pair of spaced apart mounting points such that the alignment band establishes a straight base line between the points. Each of the opposed tension members has one end attached to the head of a golf club. The other ends of the tension members are attached to the mounting points such that the tension members are parallel to each other and the club head has two opposing forces acting on it. As a result, the tension members urge the head of the golf club into alignment with the base line established by the alignment band. When using the device, the golfer stands adjacent the alignment band so that the club head is positioned between the mounting points and then moves the club head back and forth along the base line against the tension of the opposed tension members. To vary the tension, tension members of different elastic moduli are used. The device is specifically designed only to encourage movement along a straight path between the mounting points and therefore does not facilitate any type of arcing movement of the club head. Since the tension members are opposed, the club head is encouraged to move only in a straight path.

U.S. Pat. No. 5,013,045, issued May 7th, 1991 to Elmore is also directed at a device for exercising and training a golf swing. The device is comprised of two tension members, each having a connector adapted to releasably connect the tension member to a golf club shaft. Each tension member is anchored to the ground at an anchoring point such that the two tension members form a straight line extending forwardly and rearwardly from the club shaft so that the shaft always has two directly opposing horizontal forces acting on it in addition to two complementary vertical forces. In use, the golfer stands adjacent the device so that the club head is positioned between the anchoring points and then the club head is moved by the golfer along a single straight line along the surface between the anchoring points. To increase or decrease the exercising force on either the back swing or the follow through, the club's starting point is moved along the line closer to one of the anchoring points and away from the other anchoring point. Like the Self device, this device also is designed only to encourage movement along a straight path between the anchoring points and is not designed to encourage any type of arcing movement of the club head.

There is therefore a need for an apparatus for use by a golfer for simulating a golf swing in order to learn and practice the golf swing, which apparatus encourages body motions creating a swing arc, and which facilitates a full golf swing creating a swing arc.

DISCLOSURE OF INVENTION

The present invention relates to an apparatus and method for use by a golfer for simulating a golf swing which includes a platform, a handle for simulating a golf club grip and two resistance cords extending between the grip and the platform. The apparatus is used to encourage body motions creating a swing arc when the golfer stands on the platform, grips the handle and performs the golf swing.

In one aspect of the invention, the invention is an apparatus for use by a golfer for encouraging body motions creating a swing arc when simulating a golf swing while using the apparatus, the swing arc having an apex, the apparatus comprising:

(a) a handle for gripping by the golfer when simulating the golf swing, the handle having a proximal end and a distal end;

(b) an extendible first resistance cord for providing a first resistance during use of the apparatus, the first resistance cord having a first end and a second end, the first end attached to the proximal end of the handle;

(c) an extendible second resistance cord for providing a second resistance during use of the apparatus, the second resistance cord having a first end and a second end, the first end attached to the proximal end of the handle;

(d) a platform having a front edge, a rear edge, a first side edge, a second side edge, a top surface, a standing portion for supporting the golfer, the standing portion bordered by the rear edge, and a base portion adjacent to the standing portion, the base portion bordered by the front edge;

(e) a first platform point associated with the base portion of the platform, the first platform point defining a location of interface between the first resistance cord and the platform;

(f) a second platform point associated with the base portion of the platform, the second platform point defining a location of interface between the second resistance cord and the platform; and wherein the first platform point and the second platform point are offset towards the front edge of the platform from a first imaginary line defined by the intersection of the platform by a first vertical plane which is tangent to the apex of the swing arc, the swing arc defined by the movement of the proximal end of the handle when the golfer stands on the standing portion of the platform facing the base portion, grips the handle, and performs the golf swing.

In the preferred embodiment of the invention, the first resistance cord and the second resistance cord are both elastic cords, and the first resistance provided by the first resistance cord is preferably less than the second resistance provided by the second resistance cord as a result of the first resistance cord having a relaxed length which is greater than the relaxed length of the second resistance cord.

The first platform point and the second platform point may each be associated with the base portion of the platform at any position which is offset towards the front edge of the platform from the first line, but they are preferably situated on opposite sides of a second line defined by the intersection of the platform with a second vertical plane which is normal to the apex of the swing arc and are also preferably offset towards the front edge of the platform from the first line such that each of the first resistance cord and the second resistance cord have an azimuth angle of between about 40 degrees and 50 degrees when the golfer stands on the standing portion of the platform facing the base portion, grips the handle, and positions the handle at the apex of the swing arc. The azimuth angle of each of the first resistance cord and the second resistance cord may be reduced by elevating the first platform point and the second platform point relative to the standing portion of the platform, either by elevating them relative to the platform, or alternatively, as in the preferred embodiment, by elevating the front edge of the platform so that the base portion of the platform forms a slope descending from the front edge of the platform. In the preferred embodiment, the azimuth angle of each of the first resistance cord and the second resistance cord is less than about 45 degrees, but the azimuth angle may be any angle which is less than 90 degrees.

In the preferred embodiment, the first platform point is closer to the first side edge of the platform than is the second platform point, and the first platform point is closer to the front edge of the platform than is the second platform point. In the preferred embodiment, the handle passes the second side edge of the platform during the follow through portion of the golf swing before passing the first side edge of the platform, with the result that the first side edge of the platform is the opposite side edge of the platform for a right handed golfer than it is for a left handed golfer. In the preferred embodiment, a third line passing through the first platform point and the second platform point forms a bearing angle relative to the first line of between about 0 degrees and 45 degrees, and the bearing angle is most preferably about 20 degrees.

In the preferred embodiment, the standing portion of the platform comprises a substantially planar first lateral portion and a substantially planar second lateral portion which are inclined relative to each other such that the standing portion is substantially V-shaped.

In the preferred embodiment, the invention further comprises a first connector for attaching the first resistance cord to the platform and a second connector for attaching the second resistance cord to the platform. The first and second connectors may be located at the first and second platform points respectively, but preferably, the first platform point is defined by a first aperture in the top surface of the platform, the second platform point is defined by a second aperture in the top surface of the platform, the second end of the first resistance cord is passed through the first aperture to the first connector, and the second end of the second resistance cord is passed through the second aperture to the second connector.

The invention preferably further comprises first means for adjusting the first resistance and second means for adjusting the second resistance. In the preferred embodiment, where the first and second resistance cords are elastic cords, the first adjusting means and the second adjusting means adjust the resistance of the first and second resistance cords by changing their respective effective lengths. This is accomplished by a first adjusting reel assembly and a second adjusting reel assembly, wherein the first adjusting reel assembly comprises a first reel for winding up and paying out the first resistance cord and a first means for locking the first reel in a desired first reel position, and wherein the second adjusting reel assembly comprises a second reel for winding up and paying out the second resistance cord and a second means for locking the second reel in a second desired reel position. Preferably, as in the preferred embodiment, the first reel and the second reel are fixedly mounted on a single axle, and the first and second locking means comprise a brake which releasably engages the axle.

In the preferred embodiment, the second end of the first resistance cord includes a first extendible adjusting cord, and the second end of the second resistance cord includes a second extendible adjusting cord. The first and second adjusting cords extend from the first connector and the second connector respectively, and each of the first adjusting cord and the second adjusting cord comprises a ring connector for engaging the first and second platform points when the apparatus is not in use.

Finally, in the preferred embodiment, the apparatus may also comprise a mirror located on the top surface of the platform for enabling the golfer to observe the golf swing while using the apparatus and to assist the golfer in avoiding swaying backward or forward against the resistance of the resistance cords.

In a second aspect of the invention, the invention comprises a method for use by a golfer for encouraging body motions creating a swing arc when simulating a golf swing while using an apparatus of the type as described above, the method comprising the following steps performed by the golfer:

(a) standing on the standing portion of the platform, facing the base portion, in a golf stance;

(b) gripping the handle using a golf grip; and (c) performing the golf swing;

wherein the golfer stands on the standing portion of the platform such that the first platform point and the second platform point are offset towards the front edge of the platform from the first line.

In a third aspect of the invention, the invention comprises a method for use by a golfer for encouraging body motions creating a swing arc, the swing arc having an apex, when simulating a golf swing while using an apparatus of the type comprising a handle for gripping by the golfer when simulating the golf swing, the handle having a proximal end and a distal end, an extendible first resistance cord for providing a first resistance during use of the apparatus, the first resistance cord having a first end and a second end, the first end attached to the proximal end of the handle, a first connector for anchoring the second end of the first resistance cord, an extendible second resistance cord for providing a second resistance during use of the apparatus, the second resistance cord having a first end and a second end, the first end attached to the proximal end of the handle, and a second connector for anchoring the second end of the second resistance cord, the method comprising the following steps:

(a) anchoring the second end of the first resistance cord using the first connector;

(b) anchoring the second end of the second resistance cord using the second connector;

(c) assuming a golf stance while facing the first connector and the second connector;

(d) gripping the handle using a golf grip; and (e) performing the golf swing;

wherein the golfer assumes the golf stance such that the first connector and the second connector are offset away from the golfer from a first vertical plane which is tangent to the apex of the swing arc, the swing arc defined by the movement of the proximal end of the handle when the golfer performs the golf swing.

BRIEF DESCRIPTION OF DRAWINGS

Embodiments of the invention will now be described with reference to the accompanying drawings in which.

BEST MODE OF CARRYING OUT INVENTION

Figure 1:
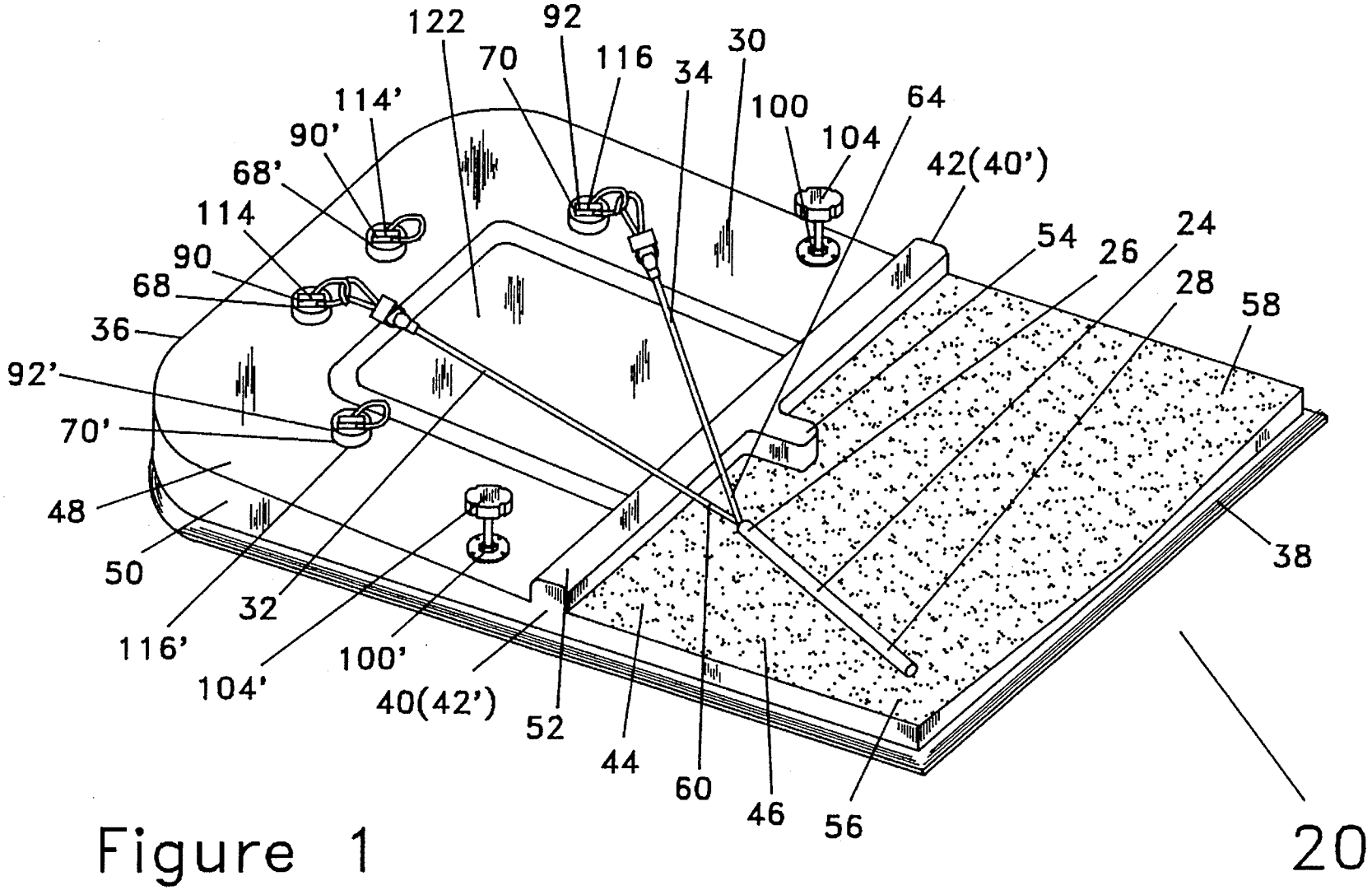
FIG. 1 is a pictorial top and side view of an apparatus configured for use by a right handed golfer, showing a top surface of a platform.
Figure 2:
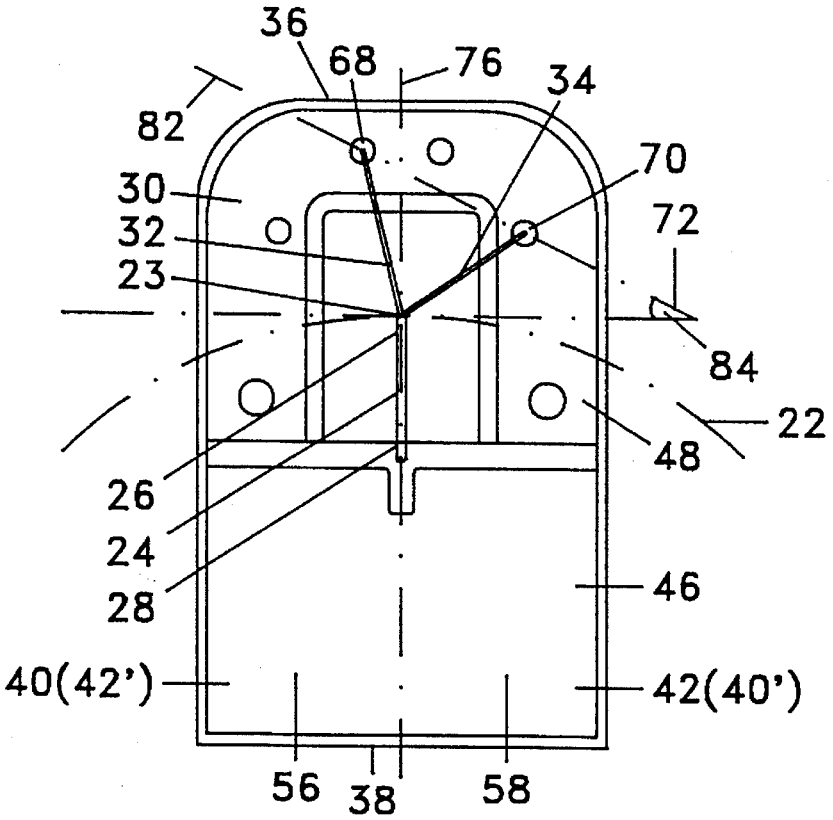
FIG. 2 is a schematic top view of the apparatus showing, in broken lines, a first imaginary line, a second imaginary line, a third imaginary line and a swing arc.
Figure 3:
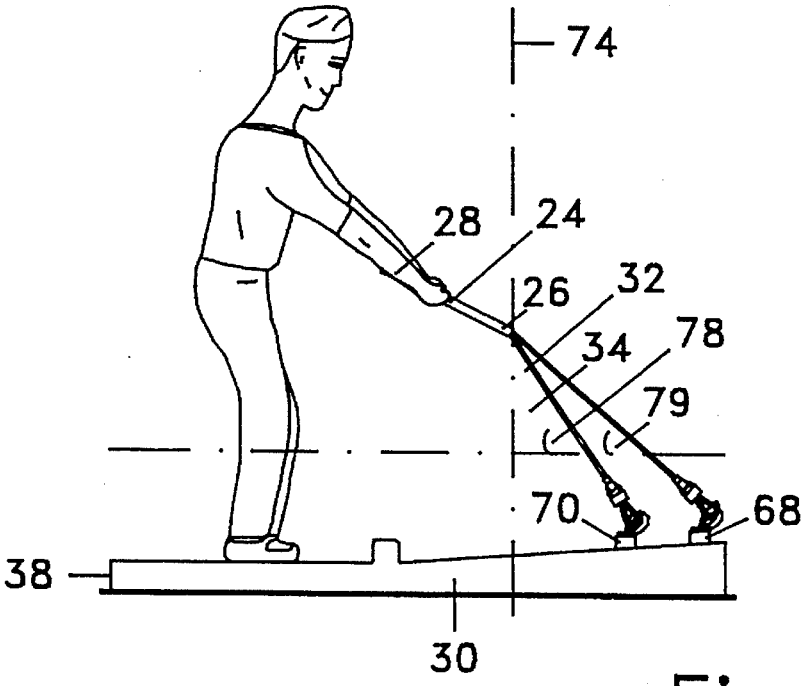
FIG. 3 is a schematic side view of the apparatus in use by the golfer showing, in broken lines, a first vertical plane and a horizontal line.

Referring to FIGS. 1–3, the invention is comprised of an apparatus (20) for use by a golfer, as shown in FIGS. 3 and 5–9. The apparatus (20) is used to encourage body motions in the golfer creating a swing arc (22) when the golfer simulates a golf swing while using the apparatus (20). The swing arc (22) has an apex (23), as shown in FIG. 2 and as defined further below.

In the preferred embodiment, the apparatus (20) is designed and is of a size for use by a golfer having an average height and body configuration for the general population including average arm and leg length and average hand size. As a result, the apparatus (20) may be used by the largest possible number of persons without modification. The apparatus (20) itself allows for some minor adjustments in position to be made by the golfer to accommodate varying body configurations and sizes. However, when the apparatus (20) is used by a golfer having a body configuration or size substantially above or below the average for the general population, the apparatus (20) may require modification from the preferred embodiment in order to achieve the design parameters set out herein.

The apparatus (20) includes a handle (24) for gripping by the golfer. The handle (24) includes a proximal end (26) and a distal end (28) as shown in FIG. 1. The handle (24) simulates the grip of a golf club while using the apparatus (20) to simulate the golf swing. The handle (20) may be formed of any rigid material, however, it preferably resembles a standard golf grip. The handle (24) is sized for a golfer having an average hand size. However, in the preferred embodiment, the handle (24) is removable from the apparatus (20) in order that it may be replaced with handles of varying sizes, shapes and weights as preferred by the golfer.

The apparatus (20) further includes a platform (30), a first resistance cord (32) extending from the proximal end (26) of the handle (24) towards the platform (30) and a second resistance cord (34) also extending from the proximal end (26) of the handle (24) towards the platform (30).

In the preferred embodiment, from a top view, the platform (30) is substantially rectangular in shape. However, the platform (30) may be of any shape as long as the platform performs the function as described herein including achievement of the correct spacial relationships between the other elements of the apparatus (20) associated with the platform (30). The platform (30)includes a front edge (36), a rear edge (38) substantially opposite the front edge (36), a first side edge (40), a second side edge (42) substantially opposite the first side edge (40), and a top surface (44). As well, the platform (30) includes a standing portion (46) bordered by the rear edge (38) for supporting the golfer and a base portion (48) bordered by the front edge (36) adjacent the standing portion (46). In the preferred embodiment, the standing portion (46) and the base portion (48) comprise the entire platform (30). Further, in the preferred embodiment, when the golfer is using the apparatus (20), the golfer stands on the standing portion (46) facing the base portion (48). Thus, the golfer is facing in the direction of the front edge (36) while the rear edge (38) is behind the golfer. With reference to the golfer in this position, the top surface (44) is the upper surface of the platform (30) facing towards the golfer. When the apparatus (20) is configured for use by a right handed golfer as depicted in FIG. 1, the first side edge (40) is defined as the edge to the left of the golfer, while the second side edge (42) is defined as the edge to the right of the golfer. However, the side edges are reversed when the apparatus (20) is configured for use by a left handed golfer.

Preferably, the entire platform (30) is integrally constructed of an injection molded plastic to form a single piece. However, the base (48) and the standing (46) portions of the platform (30) may be formed separately in which case they are preferably either releasably or permanently connected to each other for use of the apparatus (20). When used, the weight of the golfer standing on the standing portion (46) of the platform (30) is typically sufficient to anchor the apparatus (20) to the ground and inhibit movement of the platform (30). However, if for any reason movement of the platform (30) occurs during use, the platform (30) may be anchored to the ground by any known means of restraint.

As shown in FIG. 1 in which the apparatus (20) is configured for use by a right handed golfer, the platform (30) forms a hollow shell, when molded of a single piece, such that a side surface (50) is located adjacent the front edge (36), the rear edge (38), the first side edge (40) and the second side edge (42) about the entire perimeter of the top surface (44). The side surface (50) extends from the top surface (44) to the ground and raises the top surface (44) off of the ground. As well, in the preferred embodiment, a raised border (52) is molded into the top surface (44) between the standing portion (46) and the base portion (48). The raised border (52) inhibits the golfer from moving off of the standing portion (46) and onto the base portion (48) during use of the apparatus (20) and thus encourages proper usage of the apparatus (20) by encouraging correct positioning of the golfer on the apparatus (20). Further, a raised guide (54) extends from the raised border (52) midway between the first and second side edges (40, 42) into the standing portion (46) in the direction of the rear edge (38). In use, the golfer stands on the standing portion (46) with one foot on either side of the raised guide (54). Thus, the raised guide (54) acts to further encourage correct positioning of the golfer on the apparatus (20). As well, the top surface (44) of the standing portion (46) may be covered with a non-slip surface.

Preferably, the standing portion (46) is comprised of a substantially planar first lateral portion (56) adjacent the first side edge (40) and a substantially planar second lateral portion (58) adjacent the second side edge (42). The first and second lateral portions (56, 58) are preferably approximately equal in size such that the raised guide (54) extends between the first and second lateral portions (56, 58). The first and second lateral portions (56, 58) are designed so that the golfer may place one foot on each of the lateral portions (56, 58). Thus, in use, the golfer's left foot is placed on the first lateral portion (56) and the golfer's right foot is placed on the second lateral portion (58).

As shown in FIG. 1, the first lateral portion (56) and the second lateral portion (58) are preferably inclined relative to each other such that, when viewed from the rear edge (38), the standing portion (46) is substantially V-shaped. The inclined lateral portions (56, 58) may encourage the golfer to balance his weight on the inside edges of his feet, which may improve the golf swing. In order to achieve this function, the incline of each of the lateral portions (56, 58) is preferably approximately 5 degrees from the horizontal.

The first resistance cord (32) is an extendible cord which provides for a first resistance during use of the apparatus (20). The first resistance cord (32) has a first end (60) and a second end (62). The first end (60) is attached to the proximal end (26) of the handle (24). The second resistance cord (34) is also an extendible cord which provides for a second resistance during use of the apparatus (20). The second resistance cord (34) has a first end (64) and a second end (66). The first end (64) is similarly attached to the proximal end (26) of the handle (24). In the preferred embodiment, the first and second resistance cords (32, 34) are elastic cords, such as latex tubing. However, the cords need not be elastic if a different mechanism is included to provide for extendability of the cords (32, 34).

Figure 4:
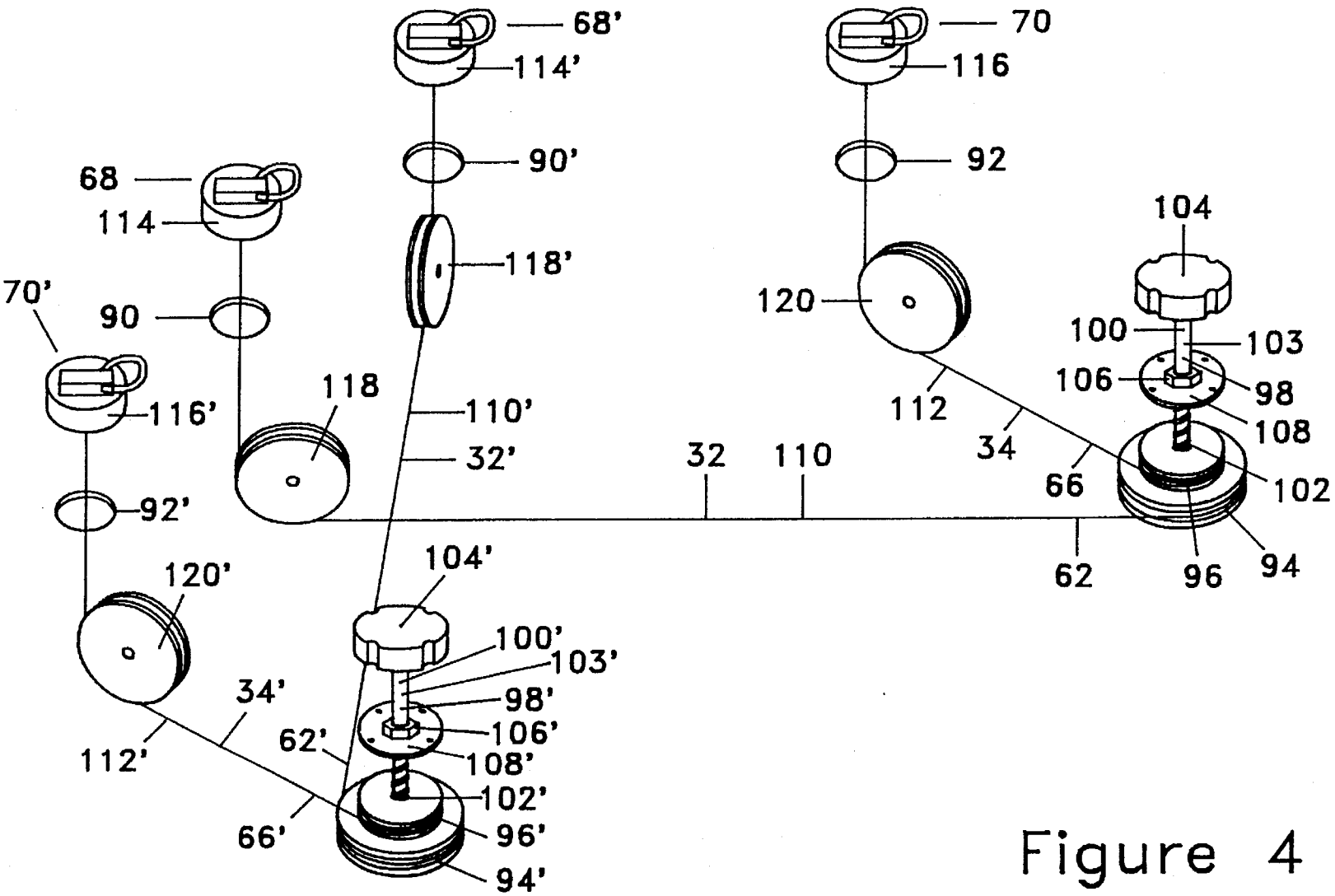
FIG. 4 is a detailed schematic view of a first and a second adjusting reel assembly and a first and a second adjusting cord for use by a right handed golfer, and an alternate first and an alternate second adjusting reel assembly and an alternate first and an alternate second adjusting cord for use by a left handed golfer, the adjusting reel assemblies and the adjusting cords being shown in isolation apart from the platform.

A first platform point (68) and a second platform point (70) are also associated with the base portion (48) of the platform (30). In the description contained herein regarding the detailed structure of the platform points and the remainder of the apparatus (20), the description is specifically directed at the apparatus (20) as configured for a right handed golfer. A different version of the apparatus (20) may be constructed to be configured for use by a left handed golfer, in which case the side edges and the location of the platform points will be reversed. Alternatively, FIG. 4 depicts how in the preferred embodiment, the apparatus (20) is constructed so that the same apparatus (20) may be configured for either a right handed golfer or a left handed golfer. In referring to the Figures, including FIG. 4, the numbers without a prime (') designation are provided for the preferred embodiment of the apparatus as configured for a right handed golfer whereas the numbers with a prime (') designation are provided for the apparatus as configured for a left handed golfer. Where a number with a prime (') designation is used, the structure, operation and parameters of the elements so designated are the same in all respects as those for the elements designated by the same number without the prime (') designation.

The first platform point (68) defines a location of interface between the first resistance cord (32) and the platform (30), while the second platform point (70) defines a location of interface between the second resistance cord (34) and the platform (30). The platform points (68, 70) are not concurrent, instead two distinct or discrete locations of interface are defined by the platform points (68, 70). The specific manner of interface between each of the resistance cords (32, 34) and the platform (30) may vary as long as each platform point (68, 70) defines the specific location on the platform (30) of that interface. The preferred manner of interface is described below.

As shown in FIGS. 2 and 3, the first and second platform points (68, 70) and thus, the locations of interface, are associated with the base portion (48) of the platform (30) and are located relative to a first imaginary line (72). The first imaginary line (72) is defined by the intersection of the base portion (48) of the platform (30) by a first vertical plane (74). The first vertical plane (74) is tangent to the apex (23) of the swing arc (22).

The swing arc (22) is defined by the movement of the proximal end (26) of the handle (24) when the golfer stands on the standing portion (46) of the platform (30) facing the base portion (48), grips the handle (24) and performs the golf swing. While the golfer is performing the swing arc (22), the apparatus (20) may encourage body motions creating an ideal or otherwise fundamentally sound golf swing, as known to a person skilled in the art. An ideal or fundamentally sound golf swing incorporates a swing arc which enhances or facilitates the golfer's ability to consistently hit the golf ball accurately and maximize the distance that the golfer is able to hit the golf ball. The specific shape of the swing arc (22) performed by the golfer when using the apparatus (20) need not correspond to that indicated in FIG. 2 as long as the location of the platform points (68, 70) in relation to the first imaginary line (72) satisfy the requirements set out herein.

The first platform point (68) and the second platform point (70) are offset towards the front edge (36) of the platform (30) from the first imaginary line (72). The platform points (68, 70) must not be located either on the first imaginary line (72) or between the first imaginary line (72) and the rear edge (38) of the platform (30). By requiring the platform points (68, 70) to be offset from the first imaginary line (72) towards the front edge (36), the first resistance cord (32) and the second resistance cord (34) will not be parallel to each other at any time during performance of the swing arc (22).

The first platform point (68) is preferably located closer to the first side edge (40) of the platform (30) than is the second platform point (70). The platform points (68, 70) are also preferably located in specific positions relative to a second imaginary line (76). The second imaginary line (76) is defined by the intersection of the platform (30) with a second vertical plane. The second vertical plane is normal to the apex (23) of the swing arc (22). The first platform point (68) is preferably offset towards the first side edge (40) of the platform (30) from the second imaginary line (76) and the second platform point (70) is preferably offset towards the second side edge (42) from the second imaginary line (76). Thus, when the apparatus is configured for a right handed golfer, the first platform point (68) is offset to the left, and the second platform point (70) is offset to the right from the second imaginary line (76). The reverse is true when the apparatus is configured for a left handed golfer.

Referring to FIG. 3, in the preferred embodiment, the first platform point (68) and the second platform point (70) are offset towards the front edge (36) from the first imaginary line (68) such that the first resistance cord (32) and the second resistance cord (34) each form an azimuth angle (79, 78). The azimuth angles (79, 78) for the first and second resistance cords (32, 34) respectively are measured relative to the horizontal when the golfer stands on the standing portion (46) of the platform (30), grips the handle (24) and positions the handle (24) at the apex (23) of the swing arc (22). Although the azimuth angles (79, 78) need not be the same, each azimuth angle (79, 78) must be less than 90 degrees in order to ensure that the first and second resistance cords (32, 34) are not wholly contained in the same vertical plane at any point in the swing arc (22), and thus ensure that the horizontal components of the first resistance and the second resistance are never parallel to each other. Preferably, each azimuth angle (79, 78) is between about 40 and 50 degrees, and most preferably, is less than about 45 degrees.

In order to reduce each azimuth angle (79, 78) and assist in achieving the preferred azimuth angles (79, 78) of less than about 45 degrees, the first and second platform points (68, 70) are preferably elevated relative to the standing portion (46) of the platform (30). This may be done by elevating the platform points (68, 70) alone relative to the top surface (44) of the entire platform (30). In other words, the standing portion (46) and the base portion (48) of the platform (30) may be substantially co-planar and the platform points (68, 70) may be elevated relative to both the standing portion (46) and the base portion (48) in order to reduce the azimuth angles (79, 78). However, the azimuth angles (79, 78) are preferably reduced by elevating the front edge (36) of the platform (30) relative to the standing portion (46) of the platform (30) so that the base portion (48) forms a slope descending from the front edge (36) to the raised border (52). As a result of the slope, the first and second platform points (68, 70) which are associated with the base portion (48) are elevated relative to the standing portion (46), thus reducing the azimuth angles (79, 78). The degree of slope is chosen so as to achieve the preferred azimuth angles (79, 78) of less than about 45 degrees.

In the preferred embodiment, to encourage body motions creating a more ideal swing arc (22), the first platform point (68) is preferably closer to the front edge (36) of the platform (30) than is the second platform point (70). Thus, when the apparatus (20) is configured for use by a right handed golfer, as shown in FIG. 1, the platform point to the left of the golfer (68) is closer to the front edge (36) than the platform point to his right (70). Where the apparatus (20) is configured for a left handed golfer, the platform point to the golfer's right (68') will be closer to the front edge (36) than the platform point to his left (70'). This configuration will encourage an outside swing arc (22) which is considered preferable to an inside swing arc (22). However, the specific location of the platform points (68, 70) relative to the front edge (36) may be varied as desired by the golfer to encourage a specific swing arc (22) desired by the golfer.

Further, a third imaginary line (82) as shown in FIG. 2, passes through the first and second platform points (68, 70). The third imaginary line (82) forms a bearing angle (84) relative to the first imaginary line (72) which is preferably between about 0 degrees and 45 degrees, and is most preferably about 20 degrees, in order to encourage a desired outside swing arc (22). Thus, the relative distances of the first platform point (68) and the second platform point (70) from the front edge (36) are chosen so that the preferred bearing angle (84) is achieved, while also achieving the preferred azimuth angles (79, 78). The platform (30) may also be adapted so that the locations of the platform points (68, 70) are adjustable.

In the preferred embodiment, the first resistance provided by the first resistance cord (32) is less than the second resistance provided by the second resistance cord (34). Any manner of achieving this relationship between the first and second resistances may be used. However, in the preferred embodiment, the elastic moduli of the first and second resistance cords (32, 34) are substantially equal. As a result, to provide a first resistance less than the second resistance, the first resistance cord (32) has a relaxed length greater than the relaxed length of the second resistance cord (34). The relaxed length of each resistance cord (32, 34) is the length of the resistance cord (32, 34) at rest where no forces are being applied to the resistance cord causing it to stretch or undergo any deformation.

The apparatus (20) further includes a first connector associated with the platform (30) for attaching the first resistance cord (32) to the platform (30) and a second connector associated with the platform (30) for attaching the second resistance cord (34) to the platform (30). The first and second connectors may be located anywhere on the platform (30) as long as the other parameters of the apparatus (20) set out herein are met. For instance, the first connector may be located at the first platform point (68) and the second connector may be located at the second platform point (70). In other words, the first and second connectors may be mounted to the top surface (44) of the platform (30).

However, in the preferred embodiment, the first platform point (68) is defined by a first aperture (90) in the top surface (44) of the platform (30) and the second platform point (70) is defined by a second aperture (92) in the top surface (44) of the platform (30). Further, in the preferred embodiment, the first and second connectors are not located at the first and second apertures (90, 92) or mounted to the top surface (44) of the platform (30). Rather, the second end (62) of the first resistance cord (32) is passed from the top surface (44), through the first aperture (90) and to the first connector. As well, the second end (66) of the second resistance cord (34) is passed from the top surface (44), through the second aperture (90) and to the second connector.

The specific structure comprising the first and second connectors in the preferred embodiment is described further below. However, in the preferred embodiment, the first and second connectors are comprised of a first reel (94) and a second reel (96) respectively. Thus, the second end (62) of a first resistance cord (32) is connected at a point on the first reel (94) and the second end (66) of the second resistance cord (34) is connected at a point on the second reel (96).

In the preferred embodiment, where the platform (30) is a hollow shell, each aperture (90, 92) will pass from the top surface (44) to the inside of the shell and the second end (62, 66) of each resistance cord (32, 34) will be connected to the connectors at points inside of the shell. If the platform (30) is solid or a bottom surface (not shown) is connected to the side surface (50) opposite the top surface (44) of the platform (30), the apertures (90, 92) will preferably not pass through the entire thickness of the platform (30) or through the bottom surface. Thus, the resistance cords (32, 34) will pass into the thickness of the platform (30) for connection to the first and second connectors.

In the preferred embodiment, the first resistance and the second resistance of the first and second resistance cords (32, 34) respectively, are preferably adjustable. Adjustability is preferable to provide differing first and second resistances for different golfers having varying muscle strengths. As a result, the apparatus (20) further includes first means for adjusting the first resistance and second means for adjusting the second resistance. Preferably, the first adjusting means adjusts the first resistance by changing a first effective length of the first resistance cord (32). Similarly, the second adjusting means adjusts the second resistance by changing a second effective length of the second resistance cord (34). The first and second effective lengths of the first and second resistance cords (32, 34) respectively are the actual lengths of the resistance cords (32, 34) measured between the proximal end (26) of the handle (24) and the points of connection of the second ends (62, 66) of the resistance cords (32, 34) to either the first or second reel (94, 96).

Preferably, the connectors and the adjusting means for each resistance cord (32, 34) comprise a first and a second adjusting reel assembly mounted to the platform (30). Specifically, the first connector and the first adjusting means comprise the first adjusting reel assembly and the second connector and the second adjusting means comprise the second adjusting reel assembly. Referring to FIG. 4, the first adjusting reel assembly includes the first reel (94) which acts as the first connector as described previously. The first reel (94) also acts as the first adjusting means by winding up and paying out the first resistance cord (32). The first adjusting reel assembly also includes a first means for locking the first reel (94) in a desired first reel position. Locking of the first reel (94) in the desired first reel position will determine and set the first effective length of the first resistance cord (32). Similarly, the second adjusting reel assembly includes the second reel (96) which acts as the second connector as described previously. The second reel (96) also acts as the second adjusting means by winding up and paying out the second resistance cord (34). The second adjusting reel assembly also includes a second means for locking the second reel (96) in a desired second reel position. Locking of the second reel (96) in the desired second reel position will determine and set the second effective length of the second resistance cord (34).

In the preferred embodiment, the first and second reels (94, 96) are fixedly mounted on a single, common axle (98) so that the first adjusting reel assembly and the second adjusting reel assembly comprise a single adjusting reel assembly. The single axle (98) passes through the top surface (44) of the platform (30) and is bolted to the platform (30). The axle (98) has an upper end (100), a lower end (102) and a shaft (103). The shaft (103) of the axle (98) passes from the upper end (100) through the top surface (44) of the platform (30) to the lower end (102) within the shell of the platform (30). The upper end (100) includes a knob (104) which is accessible to the golfer. Rotation of the knob (104) by the golfer results in the rotation of the shaft (103) of the axle (98). The first and second reels (94, 96) are mounted on the lower end (102) of the axle (98), preferably by a threaded connection. Thus, rotation of the knob (104) results in rotation of both of the first and second reels (94, 96) and winding up or paying out of the resistance cords (32, 34). The axle (98) is mounted to the platform (30) in any manner allowing for rotation of the axle (98), such as by use of a nut (106) and a mounting plate (108) as shown in FIG. 4.

Since the first and second reels (94, 96) are mounted on a single axle (98), the first resistance and the second resistance can be simultaneously adjusted by turning the knob (104) to rotate the axle (98). In the preferred embodiment, rotation of the knob (104) in a clockwise direction pays out or unwinds the first and second resistance cords (32, 34) from the first and second reels (94, 96) respectively, which relaxes and thus decreases the effective length of both the first and second resistance cords (32, 34) and thus decreases the first and second resistances. Conversely, rotation of the knob (104) in a counter clockwise direction winds up the first and second resistance cords (32, 34) onto the first and second reels (94, 96) respectively, which stretches and thus increases the effective length of both the first and second resistance cords (32, 34) and thus increases the first and second resistances.

Since the first and second reels (94, 96) are mounted on a single axle (98), the first and second reels (94, 96) may also be simultaneously locked in the first and second desired reel positions by the first and second locking means by preventing rotation of the axle (98). In the preferred embodiment, the first and second locking means are comprised of a brake which releasably engages the axle (98). The brake may be any type of known braking mechanism including a ratchet and pawl assembly associated with the axle (98) or some form of frictional braking mechanism.

In the preferred embodiment, referring to FIG. 4, the second end (62) of the first resistance cord (32) includes a first extendible adjusting cord (110) for connecting the first resistance cord (32) to the first reel (94). Similarly, the second end (66) of the second resistance cord (34) includes a second extendible adjusting cord (112) for connecting the second resistance cord (34) to the second reel (96). The first adjusting cord (110) extends from the point of connection on the first reel (94) to a first ring connector (114). The first ring connector (114) releasably connects the first adjusting cord (110) to the remainder of the first resistance cord (32). The second adjusting cord (112) extends from the point of connection on the second reel (96) to a second ring connector (116), which releasably connects the second adjusting cord (112) to the remainder of the second resistance cord (34). The apparatus (20) can be alternately configured for use by either a right handed golfer or a left handed golfer by utilizing ring connectors (114, 116) for a right handed golfer or utilizing ring connectors (114', 116') for a left handed golfer. In the preferred embodiment, the length of the first adjusting cord (110) is greater than the length of the second adjusting cord (112). As a result, the diameter of the first reel (94) is proportionately greater than the diameter of the second reel (96), so that the first adjusting cord (110) and the second adjusting cord (112) can be relaxed and stretched proportionately by rotation of the knob (104).

When the apparatus (20) is not in use, the first and second ring connectors (114, 116) are designed to engage the first and second platform points (68, 70) respectively. Specifically, the first and second ring connectors (114, 116) abut against the top surface (44) of the platform (30) adjacent the first and second apertures (90, 92) respectively. As the first and second adjusting cords (110, 112) pass from the first and second ring connectors (114, 116) through the first and second apertures (90, 92) to the first and second reels (94, 96), the first and second adjusting cords (110, 112) preferably pass over and engage a first and second friction reducing roller (118, 120) respectively, mounted within the shell of the platform (30). The first and second rollers (118, 120) minimize the potential wear on the first and second adjusting cords (110, 112) caused by friction between the adjusting cords (110, 112) and the platform (30) at the location of the apertures (90, 92). By winding up the resistance cords (32, 34) on the first and second reels (94, 96), the force of engagement between the ring connectors (114, 116) and the first and second apertures (90, 92) increases, thus increasing the first resistance and the second resistance. Depending upon the design of the first and second adjusting cords and the first and second reels (94, 96) the maximum force of engagement may be such that the first and second ring connectors (114, 116) do not disengage from the first and second aperture (90, 92) during use of the apparatus, with the result that the first and second connectors (114, 116) may act as rigid connectors at the first and second platform points (68, 70). When the apparatus (20) is configured for use by a left handed golfer and ring connectors (114', 116') are thus utilized, the first and second adjusting reel assemblies shown in FIG. 4 and designated by prime (') reference numbers are also utilized, with the result that the apparatus (20) can quickly and easily be changed between configurations for a right handed golfer or a left handed golfer merely by changing the set of ring connectors (114, 116 or 114', 116') that are utilized.

Finally, the apparatus (20) preferably includes a mirror (122), shown in FIG. 1, located on the top surface (44) of the platform (30). The mirror (122) enables the golfer to observe the golf swing while using the apparatus (20). The ability of the golfer to use the mirror (122) is enhanced by the slope of the base portion (48) described previously. The mirror (122) may be used by the golfer throughout the performance of the golf swing in order to assist the golfer in avoiding swaying forward or backward against the resistance of the first and second resistance cords (32, 34).

The invention is also directed at a method for use by a golfer for encouraging body motions creating the swing arc (22) when simulating the golf swing either while using the apparatus (22) described herein or while using a simplified apparatus which does not include the platform (30). The method comprises the steps performed by the golfer of standing on the standing portion (46) of the platform (30) facing the base portion (48), in the manner described previously, in a standard golf stance known to persons skilled in the art. The golfer then grips the handle (24) using a standard golf grip known to persons skilled in the art. Performance of the standing step and the gripping step are done in a manner such that the first platform point (68) and the second platform point (70) are offset towards the front edge (36) of the platform (30) from the first imaginary line (72). The golfer then performs the final step, being performance of the golf swing.

Figure 5:
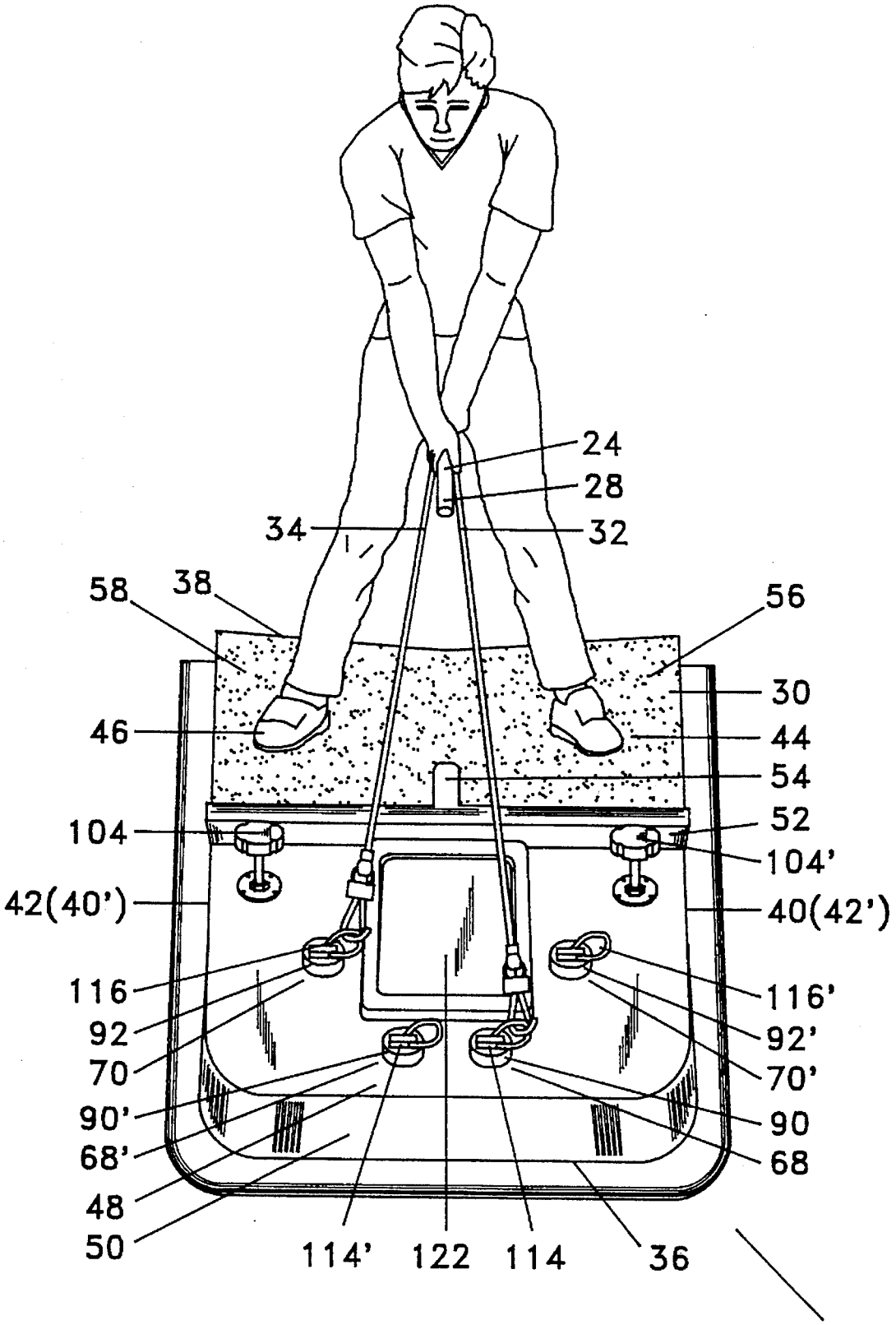
FIG. 5 is a front view of the apparatus in use by the golfer showing a first position of the golfer in a method of using the apparatus.
Figure 6:
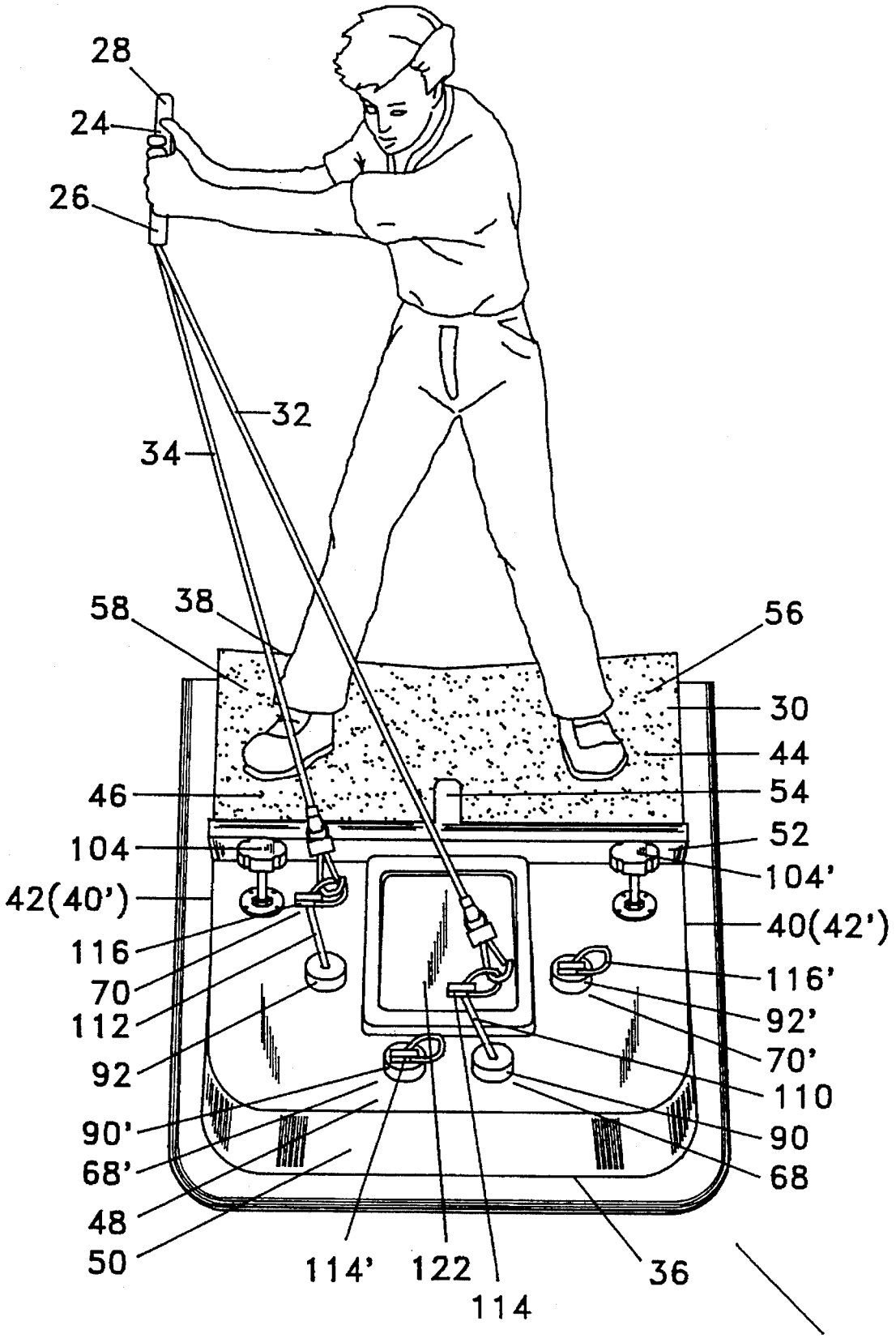
FIG. 6 is the front view of the apparatus shown in FIG. 5 showing a second position of the golfer in the method of using the apparatus.

In greater detail, referring to FIGS. 5–9, the golfer first assumes a first or address position, as shown in FIG. 5. The first position involves the golfer grasping the handle (24) so that the proximal end (26) points upwards towards the golfer and the distal end (28) points away from the golfer. The golfer also assumes a comfortable, standard golf stance. As well, the handle (24), as indicated above, is gripped using a standard golf grip. The next step in the method is to simulate the back swing portion of the golf swing to a second position as shown in FIG. 6 in which the handle (24) is positioned approximately parallel to the ground. In the second position, the golfer's left arm is extended and the right arm is slightly bent as the golfer's body commences turning in the direction of the back swing. At this point, the golfer should shift a slight amount of weight to his right foot. The second position is held against the tension in the first and second resistance cords (32, 34) for a brief period of time.

Figure 7:
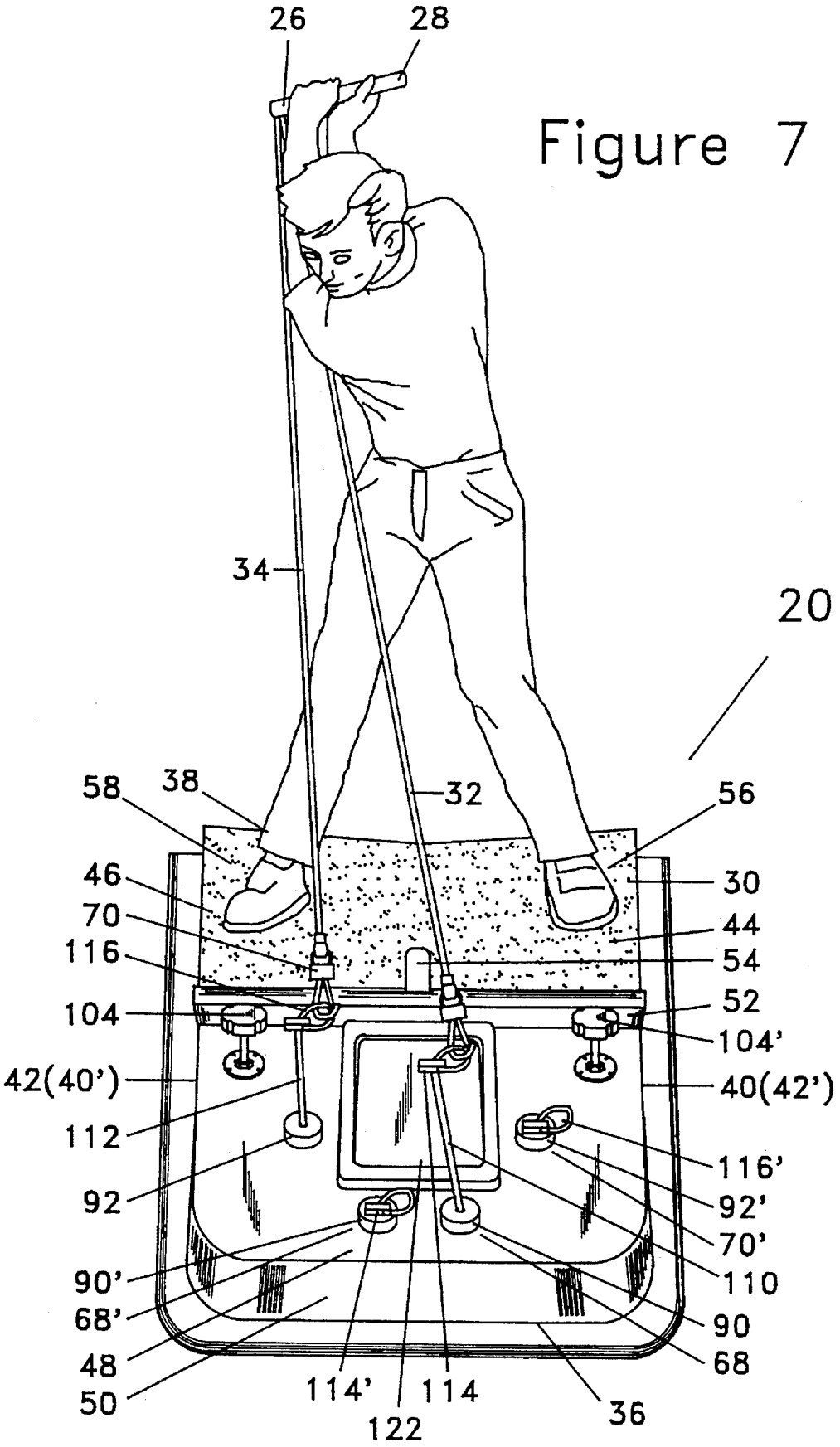
FIG. 7 is the front view of the apparatus shown in FIG. 5 showing a third position of the golfer in the method of using the apparatus.

The golfer then continues the backswing portion of the golf swing to its completion at a third position, as shown in FIG. 7. In the third position, the golfer's left arm is extended with only a slight bend at his left elbow. The right arm is bent greater than in the second position, however, the right elbow remains fairly close to the golfer's body. The golfer's shoulders have turned as far as the golfer is able to do so that the golfer's left shoulder is directly underneath the golfer's chin. More weight has shifted to the right foot but the lower body remains stable. At the third position, the golfer should attempt to minimize the turn of his hips relative to his shoulder turn. It has been found that ideally the shoulder turn at the third position should be a full 90 degrees while the hip turn is limited to approximately 45 degrees as compared to the first position. The third position is also held against the tension in the first and second resistance cords (32, 34) for a brief period of time.

The golfer then returns to the first position as shown in FIG. 5 to complete the back swing and commence the golfer's foreswing or follow through.

Figure 8:
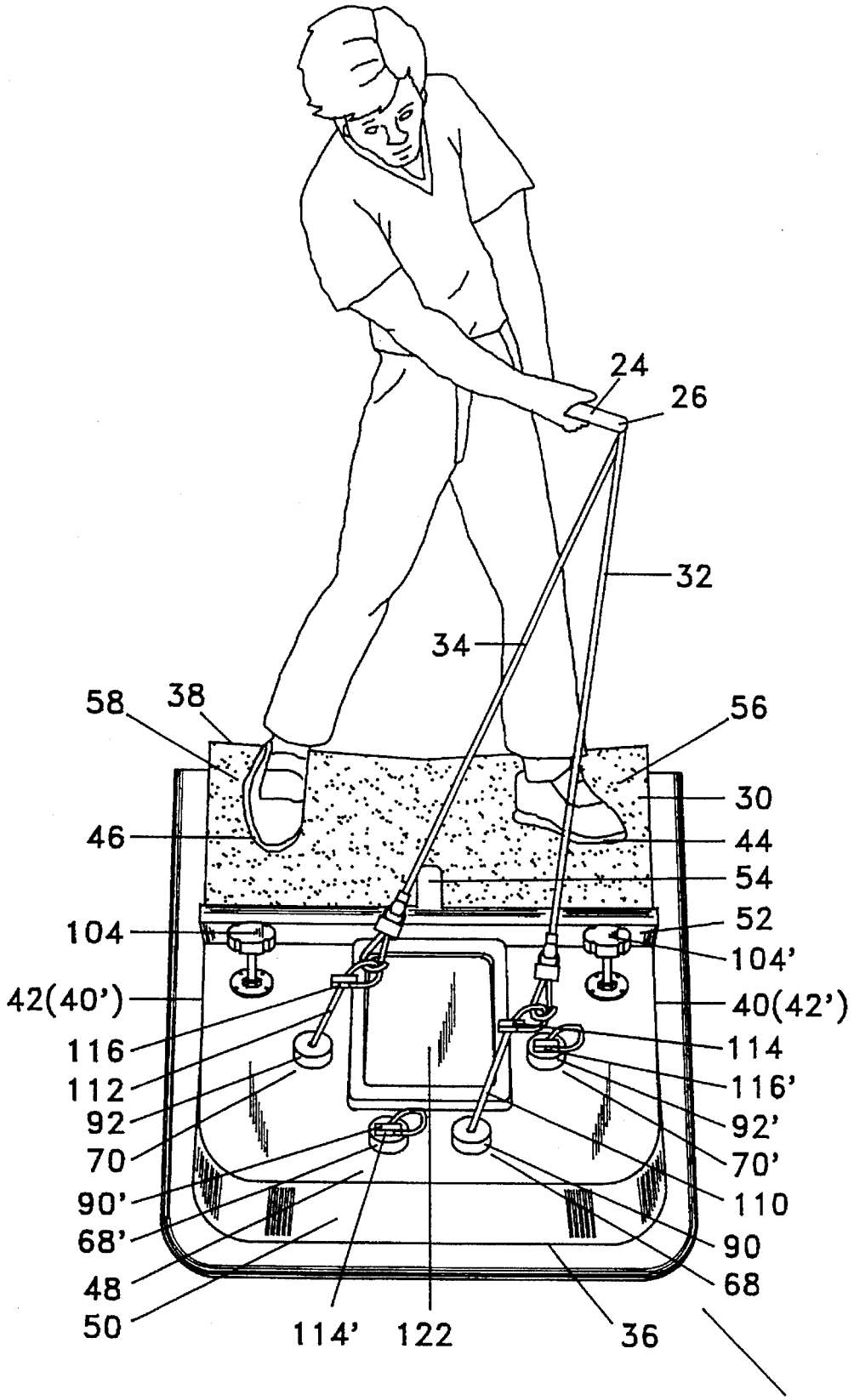
FIG. 8 is the front view of the apparatus shown in FIG. 5 showing a fourth position of the golfer in the method of using the apparatus.

The foreswing begins with the golfer inverting the handle (24) so that the proximal end (26) now points downwards, away from the golfer. It has been found that this inversion of the handle (24) may create a more realistic simulation of the forces typically found upon impact of a golf club with a golf ball. In the foreswing, the golfer swings the handle (24) to his left to a fourth position, as shown in FIG. 8. In the fourth position, the handle (24) is positioned approximately parallel to the ground and the golfer's weight is shifted almost entirely to his left foot. The fourth position is also held for a brief period of time.

Figure 9:
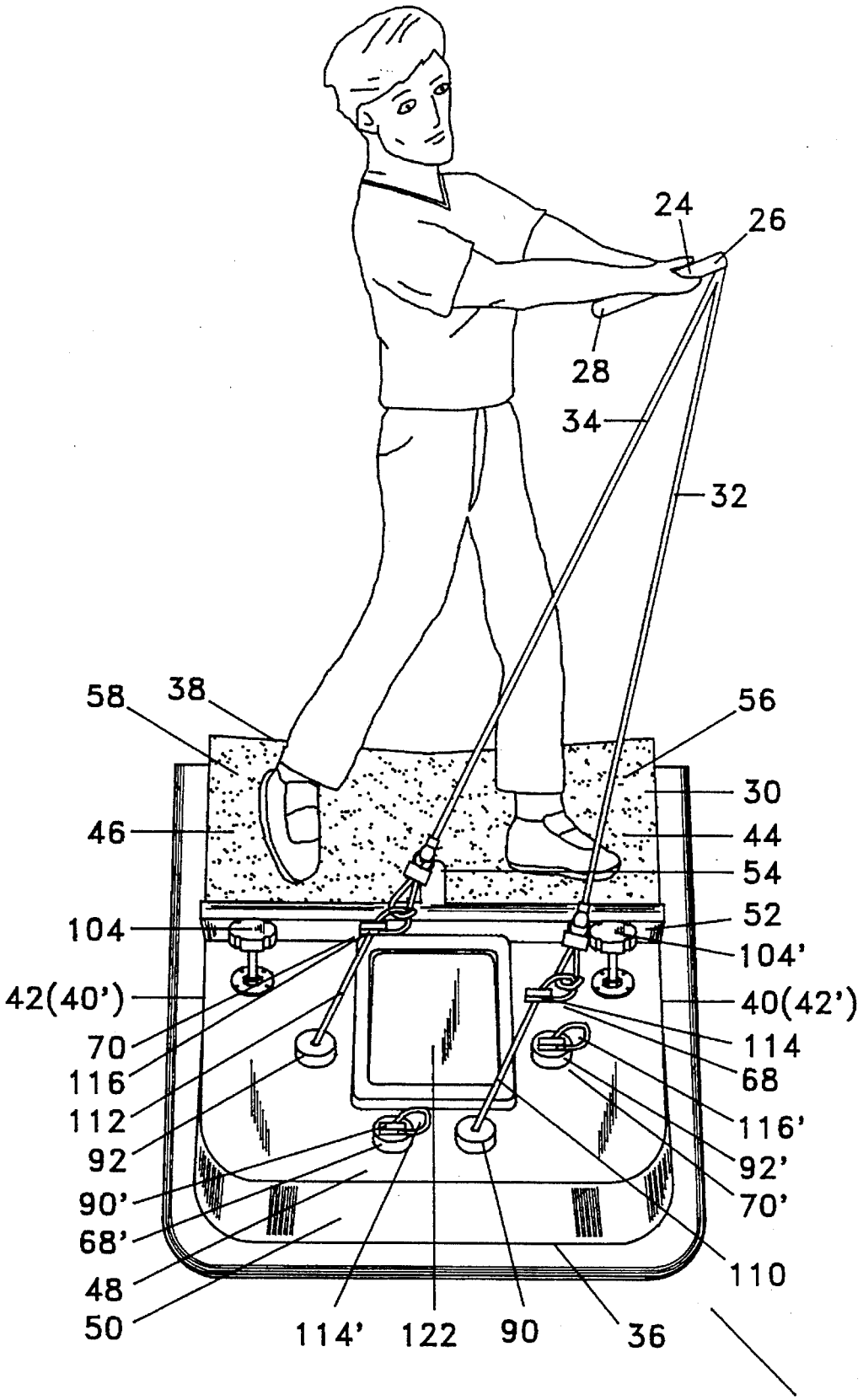
FIG. 9 is the front view of the apparatus shown in FIG. 5 showing a fifth position of the golfer in the method of using the apparatus.
Figure 2:
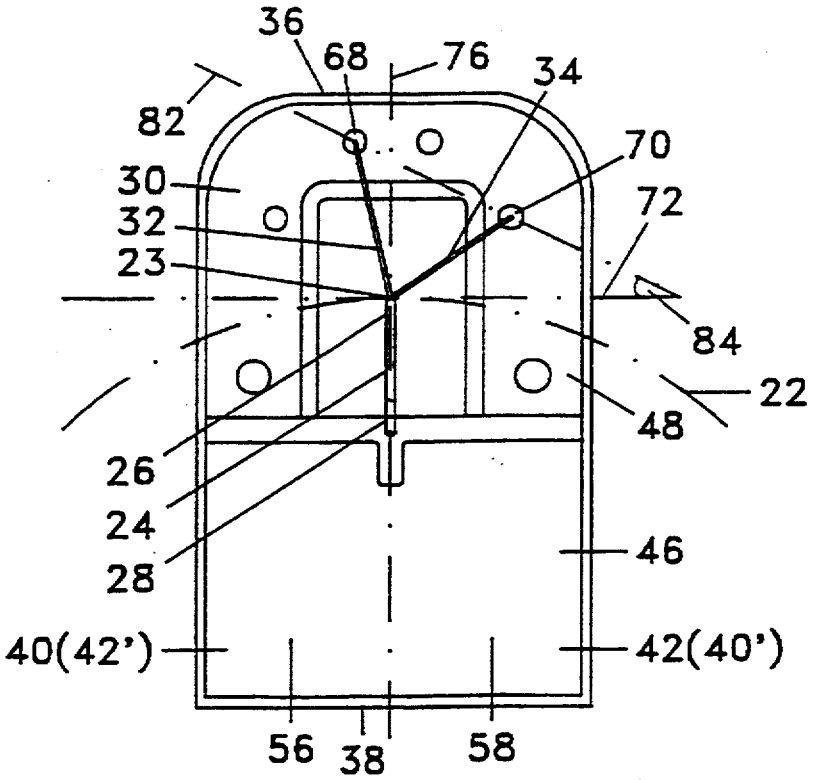
Figure 3:
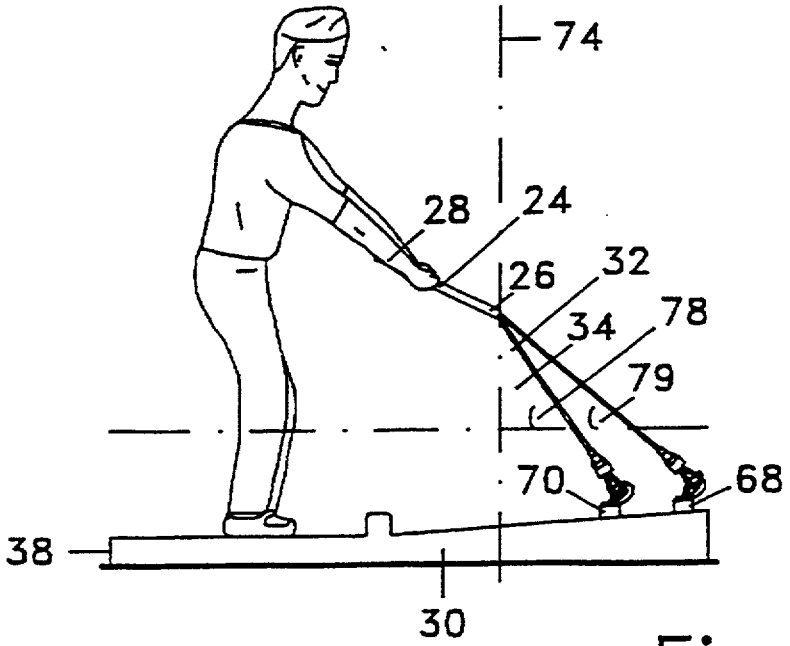

The golfer may then continue to complete the foreswing by moving to a fifth position as shown in FIG. 9. The fifth position may also be held for a brief period of time.

Each position assumed by the golfer and held against the tension in the first and second resistance cords (32, 34) should reflect the ideal or fundamentally sound golf swing, as described previously. As well, where a position is to be held for a brief period of time, it is preferable that the position be held for approximately 3 to 7 seconds.

The method of use described above is applicable with reference to a right handed golfer. Where the apparatus (20) is configured for use by a left handed golfer, the golf swing is reversed from that described above.

In addition, and as indicated above, the method of use described above may be performed either while using the apparatus (22) as described herein, or while using a simplified apparatus which does not include the platform (30), provided that the simplified apparatus is configured to provide the essential spacial relationships as described herein in conjunction with the preferred embodiment of the invention in its apparatus form.

The embodiments of the invention in which an exclusive property or privilege is claimed are defined as follows:

1. An apparatus for use by a golfer for encouraging body motions creating a swing arc when simulating a golf swing while using the apparatus, the swing arc having an apex, the apparatus comprising:

(a) a handle for gripping by the golfer when simulating the golf swing, the handle having a proximal end and a distal end;

(b) an extendible first resistance cord for providing a first resistance during use of the apparatus, the first resistance cord having a first end and a second end, the first end attached to the proximal end of the handle;

(c) an extendible second resistance cord for providing a second resistance during use of the apparatus, the second resistance cord having a first end and a second end, the first end attached to the proximal end of the handle;

(d) a platform having a front edge, a rear edge, a first side edge, a second side edge, a top surface, a standing portion for supporting the golfer, the standing portion bordered by the rear edge, and a base portion adjacent to the standing portion, the base portion bordered by the front edge;

(e) a first platform point associated with the base portion of the platform, the first platform point defining a location of interface between the first resistance cord and the platform;

(f) a second platform point associated with the base portion of the platform, the second platform point defining a location of interface between the second resistance cord and the platform; and wherein the first platform point and the second platform point are offset towards the front edge of the platform from a first imaginary line defined by the intersection of the platform by a first vertical plane which is tangent to the apex of the swing arc, the swing arc defined by the movement of the proximal end of the handle when the golfer stands on the standing portion of the platform facing the base portion, grips the handle, and performs the golf swing.

2. The apparatus as claimed in claim 1, wherein the first resistance cord and the second resistance cord are elastic cords.

3. The apparatus as claimed in claim 2, wherein the first resistance provided by the first resistance cord is less than the second resistance provided by the second resistance cord.

4. The apparatus as claimed in claim 3, wherein the first resistance cord has a relaxed length, wherein the second resistance cord has a relaxed length, and wherein the relaxed length of the first resistance cord is greater than the relaxed length of the second resistance cord.

5. The apparatus as claimed in claim 1, wherein the first platform point is offset towards the first side edge of the platform from a second imaginary line defined by the intersection of the platform with a second vertical plane which is normal to the apex of the swing arc.

6. The apparatus as claimed in claim 5, wherein the second platform point is offset towards the second side edge of the platform from the second line.

7. The apparatus as claimed in claim 1, wherein the first platform point and the second platform point are offset towards the front edge of the platform such that an azimuth angle of each of the first resistance cord and the second resistance cord is between about 40 degrees and 50 degrees when the golfer stands on the standing portion of the platform facing the base portion, grips the handle and positions the handle at the apex of the swing arc.

8. The apparatus as claimed in claim 1, wherein the first platform point and the second platform point are elevated relative to the standing portion of the platform in order to reduce an azimuth angle of each of the first resistance cord and the second resistance cord when the golfer stands on the standing portion of the platform facing the base portion, grips the handle and positions the handle at the apex of the swing arc.

9. The apparatus as claimed in claim 8, wherein the first platform point and the second platform point are elevated relative to the standing portion of the platform such that the azimuth angle of each of the first resistance cord and the second resistance cord is less than about 45 degrees.

10. The apparatus as claimed in claim 1, wherein the front edge of the platform is elevated relative to the standing portion of the platform and the base portion of the platform forms a slope descending from the front edge such that the first platform point and the second platform point are elevated relative to the standing portion of the platform in order to reduce an azimuth angle of each of the first resistance cord and the second resistance cord when the golfer stands on the standing portion of the platform facing the base portion, grips the handle and positions the handle at the apex of the swing arc.

11. The apparatus as claimed in claim 10, wherein the front edge of the platform is elevated relative to the standing portion of the platform such that the azimuth angle of each of the first resistance cord and the second resistance cord is less than about 45 degrees.

12. The apparatus as claimed in claim 10, further comprising a mirror located on the top surface of the base portion of the platform, for enabling the golfer to observe the golf swing while using the apparatus.

13. The apparatus as claimed in claim 1, wherein the first platform point is closer to the first side edge of the platform than is the second platform point.

14. The apparatus as claimed in claim 13, wherein the first platform point is closer to the front edge of the platform than is the second platform point.

15. The apparatus as claimed in claim 14, wherein a third imaginary line passing through the first platform point and the second platform point forms a bearing angle relative to the first line of between about 0 degrees and 45 degrees.

16. The apparatus as claimed in claim 15, wherein the bearing angle formed by the third line relative to the first line is about 20 degrees.

17. The apparatus as claimed in claim 1, wherein the standing portion of the platform comprises a substantially planar first lateral portion and a substantially planar second lateral portion, and wherein the first lateral portion and the second lateral portion are inclined relative to each other such that the standing portion is substantially V-shaped.

18. The apparatus as claimed in claim 1, further comprising a first connector associated with the platform for attaching the first resistance cord to the platform and a second connector associated with the platform for attaching the second resistance cord to the platform.

19. The apparatus as claimed in claim 18, wherein the first connector is located at the first platform point, and wherein the second connector is located at the second platform point.

20. The apparatus as claimed in claim 18, wherein the first platform point is defined by a first aperture in the top surface of the platform, wherein the second platform point is defined by a second aperture in the top surface of the platform, wherein the second end of the first resistance cord is passed through the first aperture to the first connector, and wherein the second end of the second resistance cord is passed through the second aperture to the second connector.

21. The apparatus as claimed in claim 20, further comprising first means for adjusting the first resistance and further comprising second means for adjusting the second resistance.

22. The apparatus as claimed in claim 21, wherein the first resistance cord and the second resistance cord are elastic cords, wherein the first resistance cord has a first effective length from the proximal end of the handle to the first connector, wherein the second resistance cord has a second effective length from the proximal end of the handle to the second connector, wherein the first adjusting means adjusts the first resistance by changing the first effective length, and wherein the second adjusting means adjusts the second resistance by changing the second effective length.

23. The apparatus as claimed in claim 22, wherein the first connector and the first adjusting means comprise a first adjusting reel assembly mounted to the platform, and wherein the second connector and the second adjusting means comprise a second adjusting reel assembly mounted to the platform.

24. The apparatus as claimed in claim 23, wherein the first adjusting reel assembly comprises a first reel for winding up and paying out the first resistance cord and a first means for locking the first reel in a desired first reel position, and wherein the second adjusting reel assembly comprises a second reel for winding up and paying out the second resistance cord and a second means for locking the second reel in a desired second reel position.

25. The apparatus as claimed in claim 24, wherein the first reel and the second reel are fixedly mounted on a single axle so that the first resistance and the second resistance can be adjusted simultaneously by rotation of the axle and so that the first reel and the second reel can both be locked in the first desired reel position and the second desired reel position simultaneously by preventing rotation of the axle.

26. The apparatus as claimed in claim 25, wherein the first locking means and the second locking means comprise a brake which releasably engages the axle.

27. The apparatus as claimed in claim 26, wherein the second end of the first resistance cord includes a first extendible adjusting cord for connecting the first resistance cord to the first connector, and wherein the second end of the second resistance cord includes a second extendible adjusting cord for connecting the second resistance cord to the second connector.

28. The apparatus as claimed in claim 27, wherein the first adjusting cord extends from the first connector and comprises a first ring connector for engaging the first platform point when the apparatus is not in use, and wherein the second adjusting cord extends from the second connector and comprises a second ring connector for engaging the second platform point when the apparatus is not in use.

29. A method for use by a golfer for encouraging body motions creating a swing arc when simulating a golf swing while using an apparatus of the type as claimed in claim 1, the method comprising the following steps performed by the golfer:

(a) standing on the standing portion of the platform, facing the base portion, in a golf stance;

(b) gripping the handle using a golf grip; and (c) performing the golf swing;

wherein the golfer stands on the standing portion of the platform such that the first platform point and the second platform point are offset towards the front edge of the platform from the first line.

30. A method for use by a golfer for encouraging body motions creating a swing arc, the swing arc having an apex, when simulating a golf swing while using an apparatus of the type comprising a handle for gripping by the golfer when simulating the golf swing, the handle having a proximal end and a distal end, an extendible first resistance cord for providing a first resistance during use of the apparatus, the first resistance cord having a first end and a second end, the first end attached to the proximal end of the handle, a first connector for anchoring the second end of the first resistance cord, an extendible second resistance cord for providing a second resistance during use of the apparatus, the second resistance cord having a first end and a second end, the first end attached to the proximal end of the handle, and a second connector for anchoring the second end of the second resistance cord, the method comprising the following steps:

(a) anchoring the second end of the first resistance cord using the first connector;

(b) anchoring the second end of the second resistance cord using the second connector;

(c) assuming a golf stance while facing the first connector and the second connector;

(d) gripping the handle using a golf grip; and (e) performing the golf swing;

wherein the golfer assumes the golf stance such that the first connector and the second connector are offset away from the golfer from a first vertical plane which is tangent to the apex of the swing arc, the swing arc defined by the movement of the proximal end of the handle when the golfer performs the golf swing.

* * * * *

UNITED STATES PATENT AND TRADEMARK OFFICE

CERTIFICATE OF CORRECTION

PATENT NO. : 5,524,893

DATED : June 11, 1996

INVENTOR(S) : Cameron J. McGinnis, et al.

It is certified that error appears in the above-indentified patent and that said Letters Patent is hereby corrected as shown below:

| | |
|---|---|
| Column 9, line 11 | change "(68)" to --(72)-- |
| Column 14, line 46 | change "(22)" to --(20)-- |
| In Fig. 2 of the drawings | redirect the lead line for Reference No. 72 to the horizontal line at angle 84 as shown in Fig. 2 of the corrected drawing sheet |

Signed and Sealed this

Fourteenth Day of January, 1997

Bruce Lehman

*Attest:*

BRUCE LEHMAN

*Attesting Officer*

*Commissioner of Patents and Trademarks*

US005524893A

Page 2 of 3

United States Patent [19]

McGinnis et al.

[11] Patent Number: 5,524,893

[45] Date of Patent: Jun. 11, 1996

[54] APPARATUS FOR GOLF SWING TRAINING

[76] Inventors: Cameron J. McGinnis; M. Warren Fuller, both of 80 Athabascan Avenue, Sherwood Park, Alberta, Canada, T8A 4E3

[21] Appl. No.: 505,561

[22] Filed: Jul. 21, 1995

[51] Int. Cl.[6] ..... A63B 69/36

[52] U.S. Cl. ..... 473/229; 482/129; 473/267; 473/409

[58] Field of Search ..... 273/186.2, 187.4, 273/191 B, 35 A; 434/252; 482/129

[56] References Cited

U.S. PATENT DOCUMENTS

| | | | |
|---|---|---|---|
| 725,876 | 4/1903 | Roche | 482/129 |
| 2,103,502 | 12/1937 | Webster | 273/188 |
| 2,455,707 | 12/1948 | Sheffer | 273/191 B |
| 2,498,006 | 2/1950 | Ridill | 273/187.2 |
| 2,655,378 | 10/1953 | Sheffer | 273/191 B |
| 2,788,214 | 4/1957 | Tilden | 273/191 B |
| 2,848,234 | 8/1958 | Brandon | 273/191 B |
| 3,083,016 | 3/1963 | Sumegi | 273/191 B |
| 3,110,495 | 11/1963 | Carter | 273/186.1 |
| 3,462,156 | 8/1969 | Gentry | 273/191 B |
| 3,595,583 | 7/1971 | Oppenheimer | 273/191 R |
| 3,604,712 | 9/1971 | Lansing et al. | 273/186 R |
| 3,703,294 | 11/1972 | Fitch | 273/191 R |
| 4,034,991 | 7/1977 | Oppenheimer | 273/191 B X |
| 4,181,310 | 1/1980 | Boehmer | 273/191 B X |
| 4,353,556 | 10/1982 | Self et al. | 273/191 B X |
| 4,383,687 | 5/1983 | Wolff | 273/35 A |
| 4,944,518 | 7/1990 | Flynn | 273/191 B X |
| 5,013,045 | 5/1991 | Elmore | 273/191 B X |
| 5,139,264 | 8/1992 | Wootten | 273/191 B X |
| 5,149,099 | 9/1992 | Radakovich | 273/189 R |
| 5,158,299 | 10/1992 | Otter | 273/191 B X |

*Primary Examiner*—George J. Marlo
*Attorney, Agent, or Firm*—Rodman & Rodman

[57] ABSTRACT

An apparatus and method for use by a golfer for simulating a golf swing. The apparatus comprises a platform for the golfer to stand on, a handle for gripping by the golfer when simulating the golf swing, and two resistance cords extending between the handle and the platform for providing a first and second resistance during performance of the golf swing by the golfer. The method comprises the steps of standing on the platform in a golf stance, gripping the handle using a golf grip, and then performing the golf swing. The method may also be performed using a simplified apparatus which does not include the platform, as long as the spacial relationship amongst the handle, the resistance cords and the golfer which is provided by the platform is maintained during performance of the method while using the simplified apparatus.

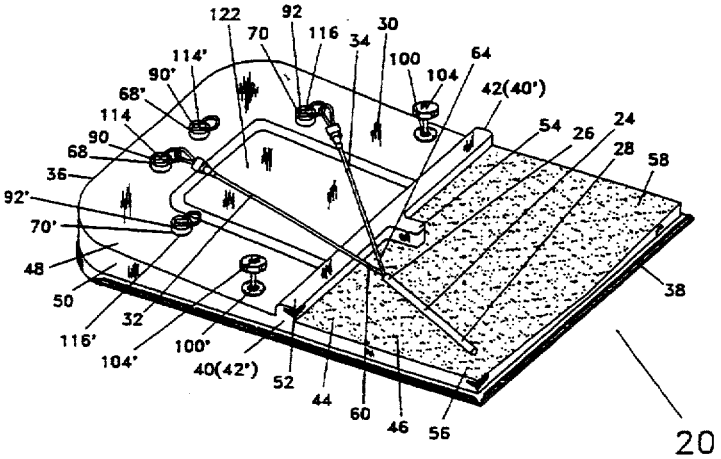

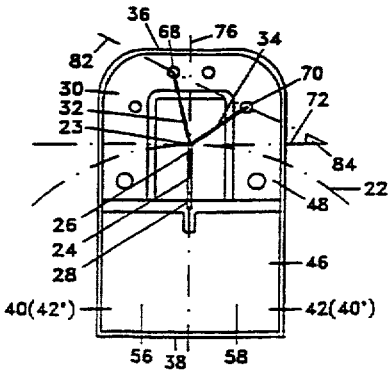

30 Claims, 8 Drawing Sheets